US010245198B2

(12) United States Patent
Lucas

(10) Patent No.: US 10,245,198 B2
(45) Date of Patent: Apr. 2, 2019

(54) LIFTING AND TRANSPORT ASSEMBLY

(71) Applicant: James Lucas, Loudon, TN (US)

(72) Inventor: James Lucas, Loudon, TN (US)

(73) Assignee: James Lucas, Charleroi, PA (US)

( * ) Notice: Subject to any disclaimer, the term of this patent is extended or adjusted under 35 U.S.C. 154(b) by 406 days.

(21) Appl. No.: 15/241,066

(22) Filed: Aug. 19, 2016

(65) Prior Publication Data

US 2018/0049934 A1 Feb. 22, 2018

(51) Int. Cl.
*A61G 7/10* (2006.01)

(52) U.S. Cl.
CPC ..... *A61G 7/1011* (2013.01); *A61G 7/1019* (2013.01); *A61G 7/1044* (2013.01); *A61G 7/1046* (2013.01); *A61G 7/1059* (2013.01)

(58) Field of Classification Search
CPC ..... A61G 7/10; A61G 7/1011; A61G 7/1013; A61G 7/1019
See application file for complete search history.

(56) References Cited

U.S. PATENT DOCUMENTS 4,399,570 A * 8/1983 Tracy ..... A61G 7/1005 114/362
5,875,501 A * 3/1999 Jury ..... A61G 7/1011 5/81.1 R
6,935,648 B2 * 8/2005 Beck ..... A61G 5/1059 280/250.1
6,941,595 B1 9/2005 Timothy
7,611,203 B1 * 11/2009 Roberts ..... A61G 7/1011 297/217.7
7,716,759 B2 * 5/2010 Wilder ..... A61G 7/1011 280/47.41
8,777,238 B1 * 7/2014 Blackwood ..... A61G 7/1011 280/47.25
9,254,233 B2 * 2/2016 Schy ..... A61G 7/1011
2003/0011228 A1 * 1/2003 Komura ..... A61G 5/14 297/344.12
2004/0075237 A1 * 4/2004 Beck ..... A61G 5/1059 280/250.1

* cited by examiner

*Primary Examiner* — Michael C McCullough

(57) ABSTRACT

A lifting apparatus for a person comprises a frame with at least two leg members fixedly attached to each other via a pair of transverse beams, a pair of vertical bars separated at a predetermined distance, wherein the vertical bars are fixedly attached to the frame via connector bars and transverse beams. The lifting apparatus comprises at least two vertical central beams fixedly attached to the frame at a predetermined position via the connector bars and transverse beams. A vertical carriage assembly comprises a seating assembly and a movable subassembly mounted on the vertical central beam and an actuator mechanism is used to elevate the vertical carriage assembly via a plurality of T-slots to slide along the vertical central beam. The design of the horizontal seating plate is smaller in size to allow the apparatus to be used in confined spaces.

14 Claims, 5 Drawing Sheets

LIFTING AND TRANSPORT ASSEMBLY

FIELD OF THE INVENTION

The present invention relates to a lifting assembly and more particularly relates to an apparatus to lift and transport persons who are not able to get up from the ground surface without assistance. This invention will give the fallen person the ability to lift themselves to a height of 24 inches from floor level by themselves with no assistance.

BACKGROUND OF THE INVENTION

The current aging population estimated at 10,000 people a day turning 65 and will maintain this level for the next twenty years most with back, knee and hip replacements. These common age related problems make it nearly impossible for them to get up from a fall by themselves. They have to wait for several hours until they get assistance from a spouse or a friend who tries to lift them but may injure themselves in the process. This invention is for these individuals that have fallen and suffer no real injuries but need assistance in getting up. Most age 65 and up have downsized and have a much smaller living area. This light weight compact unit can be bolted to the wall in any corner and protrude less than 8 inches. With this unit the fallen person may crawl to the unit pull, down the seat, use the safety belt and push a button to raise themselves to a height of 24 inches without any assistance. In a larger area, a bolt on the carriage will make the same unit mobile giving the purchaser another option. With the increasing population rate, the percentage of elderly population is also on the rise every year. Most of the people in their elderly age require assistance for doing all sorts of basic work. Even for getting up on their own, they need some assistance from an external source. There is certain section of people who are unable to do any work based on their medical complications who also need assistance to getting their job done. Without any assistance, they have to face a lot of consequences such as physical injury, lower confidence and associated trauma, or even worse physical conditions. So there has to be a person assisting these people to engage them in day-to-day activities.

Instead of employing a person to take care of the disabled person, a specialized apparatus is always a better option in handling and maintenance. For instance, to lift a person from the ground surface needs and requires others energy and time, whereas this apparatus with the cutting edge technology can do the task much easier. There have been many attempts in the prior art for a lifting apparatus for the disabled person to assist them in most of the tasks, but they have their own limitations. Some of the apparatus have cumbersome designs and they are heavy and therefore are not portable in transportation. The operation of these other apparatus requires at least two persons to handle it efficiently.

Prior art reference U.S. Pat. No. 7,716,759 B2 discloses a patient transport apparatus wherein a frame having a base and a chair support with height-adjustable seat to lift a person. However, lining up the hooks on the back of the chair may push the person to fall from the chair and also the design is large. Another prior art reference U.S. Pat. No. 6,941,595 B1 discloses a portable lift seat to raise or lower a physically challenged user from a position on the floor to a standard height seated position. However, the apparatus comprises a fork system and is a cumbersome design which may injure the person.

The design for the seating plate is large in most of the cases which adds weight to the frame. Further, in some cases, a hand crank such as a manual winch and cable is used to lift the seating assembly and it requires at least two to three persons for operation. Seating assembly in the apparatus are not flexible enough to move along the frame to lift the person from ground surface. These apparatuses are not able to be fixed to the wall or to any mobile transport carrier.

In light of the aforementioned problems of conventional and traditional lifting apparatus, there exists a need for a lightweight, easy to use, portable or stationary apparatus to lift and or transport persons who are not able to get up from the ground surface.

SUMMARY OF THE INVENTION

The present invention relates to a lightweight, easy to use, portable apparatus to lift and or transport persons who are not able to get up from the ground surface as well as those who fall down and cannot get up by themselves.

According to one embodiment, a lifting and transport apparatus for a person is disclosed. The lifting and transport apparatus comprises a frame wherein the frame comprises at least two leg members fixedly attached to each other at a first end via a first transverse beam and a second transverse beam is fixedly attached between the leg members at a predetermined distance from the first end. A plurality of wheels removable attached to a bottom section of the leg members via a fastening member to provide mobility for the apparatus. A pair of vertical bars extending from the leg members and separated at a predetermined distance, wherein the vertical bars are fixedly attached to the frame via connector bars and transverse beams and at least two vertical central beams fixedly attached to the frame at a predetermined position via the connector bars and transverse beams.

The lifting and transport apparatus further comprises a vertical carriage assembly configured to have a seating assembly and a movable subassembly mounted on the vertical central beam and an actuator mechanism used to elevate the vertical carriage assembly via a plurality of T-slots to slide along the vertical central beam. The design of the horizontal seating plate is smaller in size to allow the apparatus to be used in confined spaces.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION OF THE INVENTION

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1A:
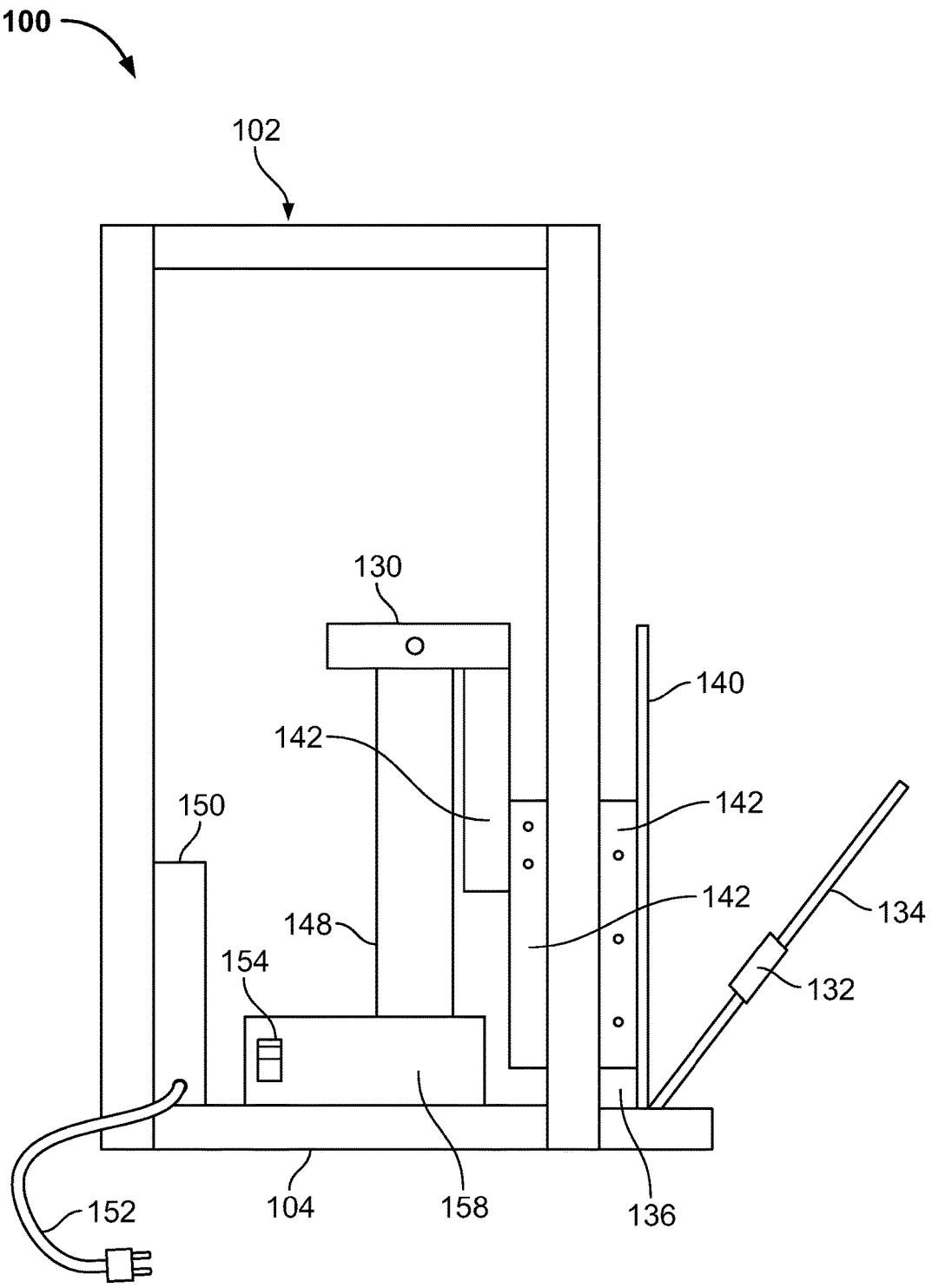
FIG. 1A shows aside view of a lifting apparatus with a vertical carriage assembly, according to an embodiment of the present invention.
Figure 1B:
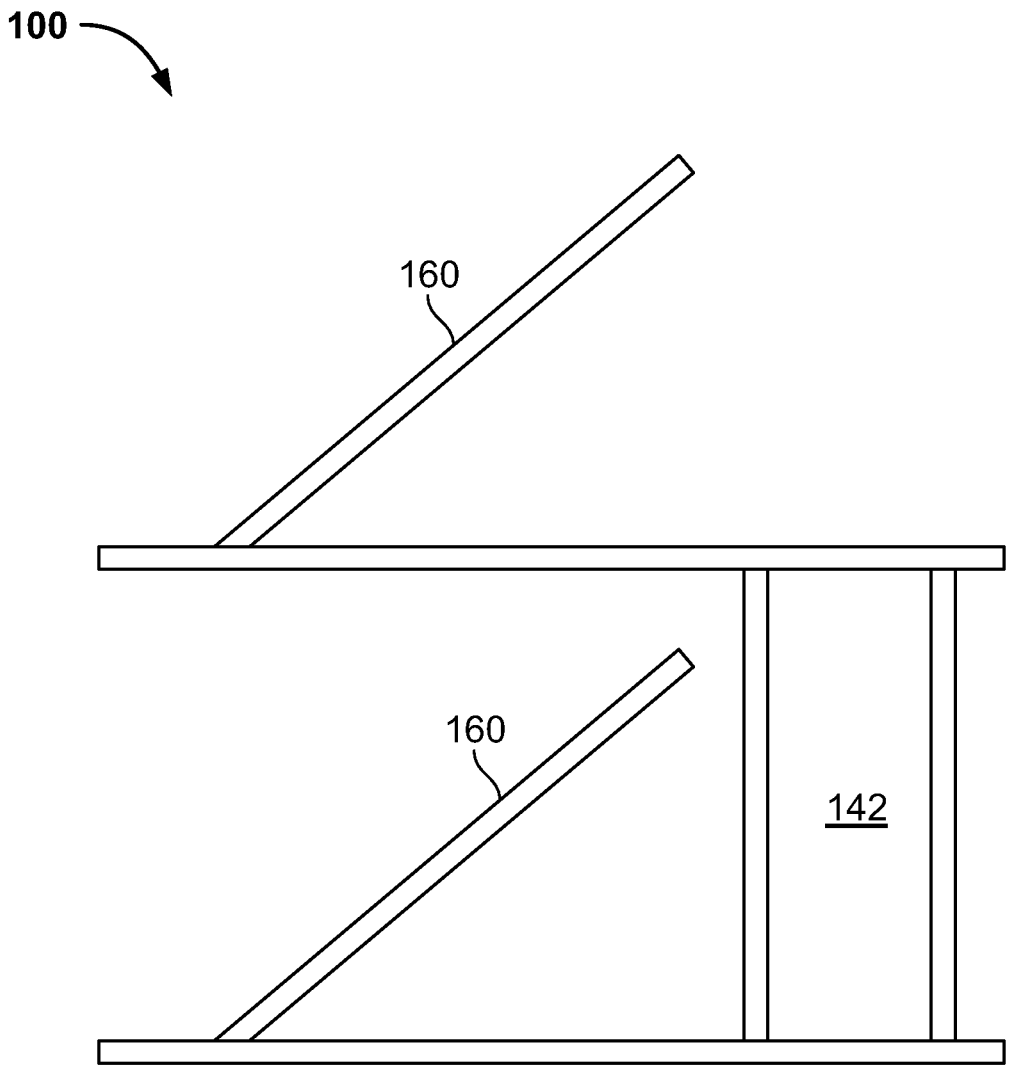
FIG. 1B shows the side view of the stationary lifting apparatus with the vertical carriage assembly, having a bolt on a forward support, according to another embodiment of the present invention.
Figure 2A:
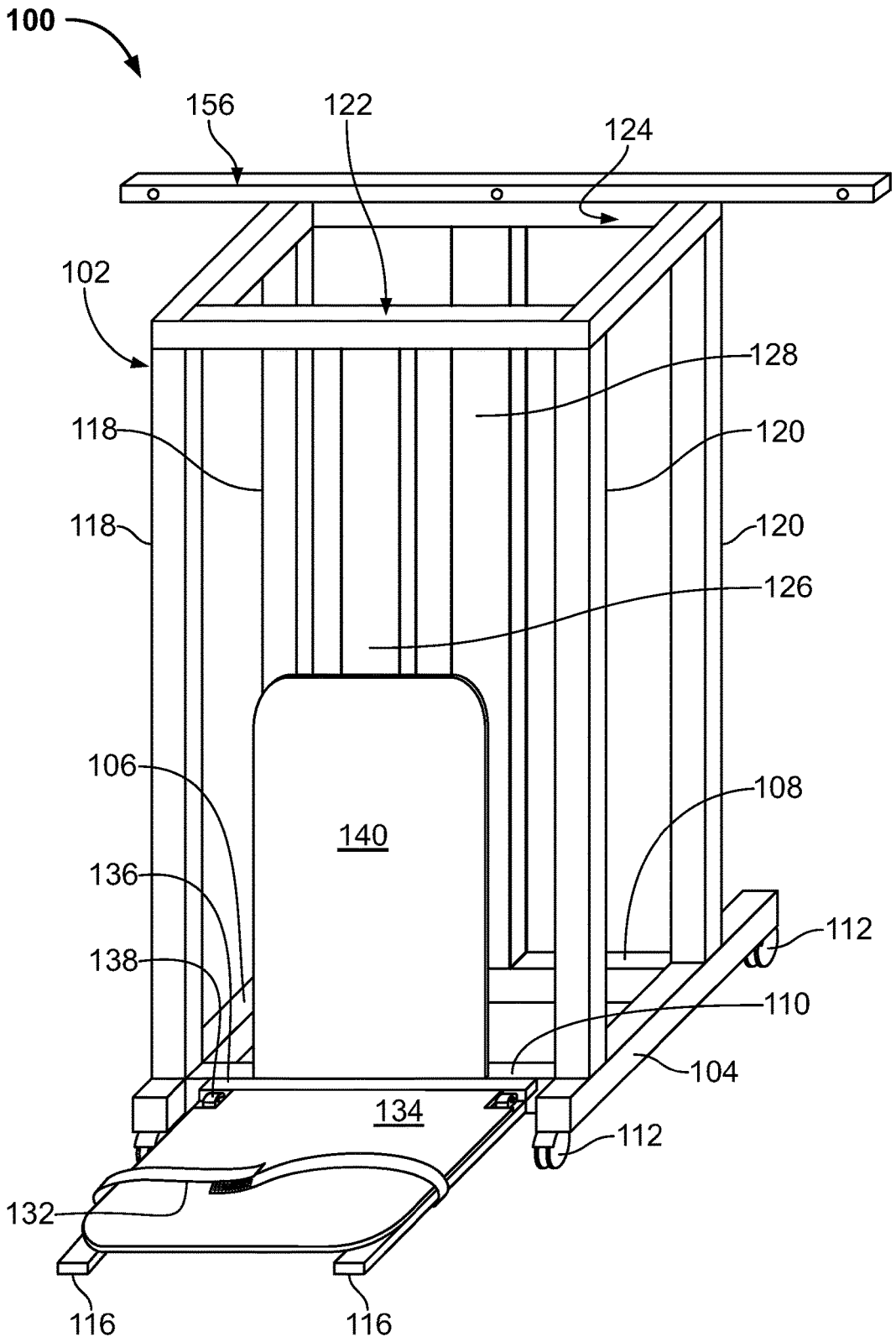
FIG. 2A shows a front perspective view of a lifting and transport apparatus with a seating assembly, and a bolt on the vertical carriage assembly according to an embodiment of the present invention.

Referring to FIG. 1A, which shows a lifting and transport apparatus 100 with a vertical carriage assembly 142 to lift a person who is not able to get up from the ground surface. The lifting and transport apparatus 100 comprises a frame 102 to elevate the vertical carriage assembly 142. The vertical carriage assembly 142 comprises a seating assembly and a movable subassembly mounted on the vertical central beam 126 is fixedly attached to the seating assembly. The seating assembly comprises a horizontal seating plate 134 attached to a support member 136 via a hinged coupling 138 and a vertical resting plate 140 fixedly attached to the support member 136. The frame 102 comprises a pair of vertical central beams (126&128) fixedly attached to and extending from the leg members (104&106) to meet the transverse beams (108&110) as shown in FIG. 2A. The horizontal seating plate 134 of the seating assembly is configured to receive and position the person using their back. The vertical resting plate 140 on the seating assembly is to assist the person to rest their shoulder, and seat belts 132 are provided to prevent the persons sitting on the seating assembly from falling down. The horizontal seating plate 134 is configured to be folded to a predetermined position via a hinged coupling 138 attached to the support member 136. In a preferred embodiment, the lifting and transport apparatus 100 as shown in FIG. 1B is a stationary type lifting apparatus 100 with a vertical carriage assembly 142 wherein a bolt member (not shown) is used on the frame 102 using the forward support 160 so that the lifting and transport apparatus 100 can be used by one person. With this stationary type lifting apparatus 100, a person who is disabled or whom is injured can crawl to the unit and raise themselves to 24 inches above ground level.

Figure 2B:
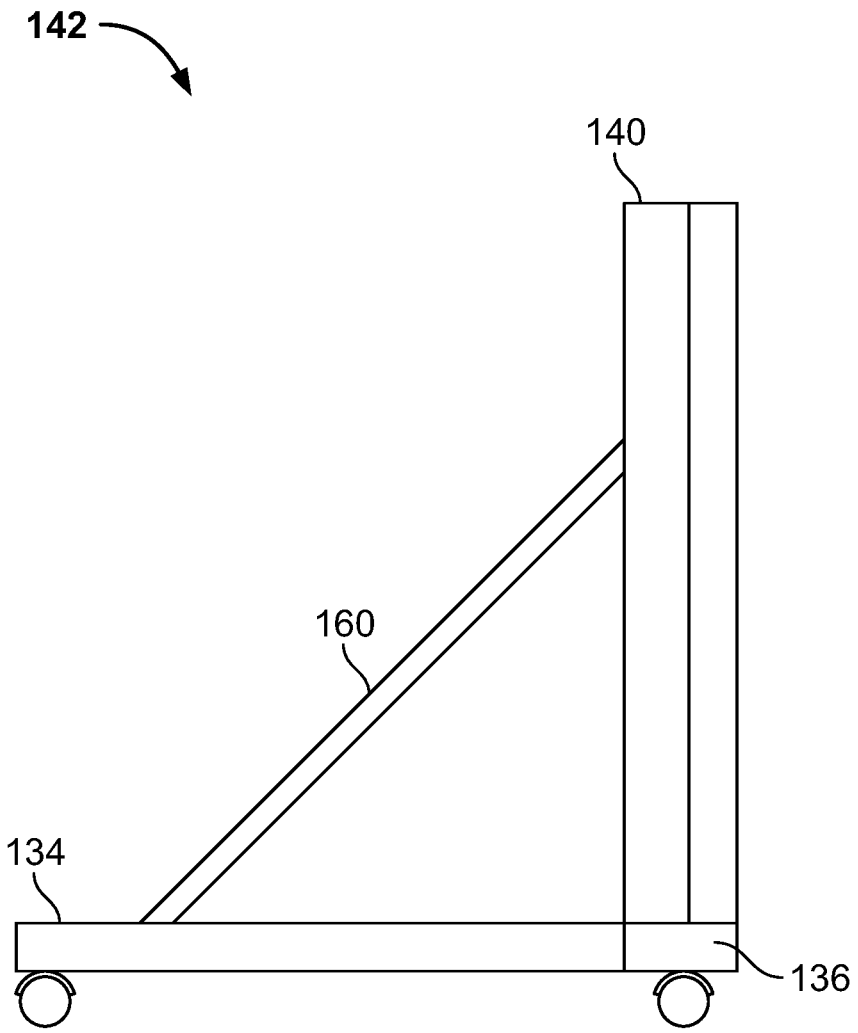
FIG. 2B shows the front perspective view of the vertical carriage assembly having the forward support and wheels, according to another embodiment of the present invention.

According to FIG. 2A, which shows the perspective view of the lifting and transport apparatus 100. The lifting and transport apparatus 100 comprises the frame 102 wherein the frame 102 comprises at least two leg members (104&106) fixedly attached to each other at a first end via a first transverse beam 108 and a second transverse beam 110 is fixedly attached between the leg members (104&106) at a predetermined distance from the first end. A plurality of wheels 112 removably attached to a bottom section of the leg members (104&106) via a fastening member to provide mobility for the apparatus 100. A pair of vertical bars (118&120) extending from the leg members (104&106) and separated at a predetermined distance, wherein the vertical bars (118&120) are fixedly attached to the frame 102 via connector bars (122&124) and transverse beams (108&110) and at least two vertical central beams (126&128) fixedly attached to the frame 102 at a predetermined position via the connector bars (122&124) and transverse beams (108&110). The frame 102 of the apparatus 100 is made from a hardened aluminum material. The leg members (104&106) and the transverse beams (108&110) provide rigidity to the frame 102 of the apparatus 100. According to FIG. 2B, the lifting and transport apparatus 100 is configured to have bolt members (not shown) in the forward support 160 of the vertical carriage assembly 142 to change the vertical carriage assembly 142 into a mobile carriage unit that can have wheels which can be moved forward to reach the disabled or injured person.

Referring to FIG. 2A, the lifting and transport apparatus 100 comprises an actuator mechanism such as linear actuator 158 to elevate the vertical carriage assembly 142 along the vertical central beam 126 in the frame 102 of the apparatus 100. In a preferred embodiment, the actuator 158 is selected from one of a hydraulic or a mechanical type. The apparatus 100 further comprises a power source 150 and a cable 152 built therein configured to provide power to the linear actuator 158 for elevating the vertical carriage assembly 142. In case of absence of power supply from the built-in power source 150, a portable power unit can be configured to provide power to the linear actuator 158. The actuator mechanism also includes a jack 148 configured to lift the seating assembly via the movable subassembly mounted on the vertical central beam 126 wherein the jack 148 is powered by the power source 150. Preferably, a DC power source can be used to power the actuation mechanism. In an exemplary embodiment, the jack 148 with a higher lifting rating can be used to lift the person who weighs more. The apparatus 100 is primarily used as a personal lift assist mainly for home use. When the apparatus 100 is mounted onto the wall via the mounting rail 156, one person is enough to operate the apparatus 100.

Figure 3:
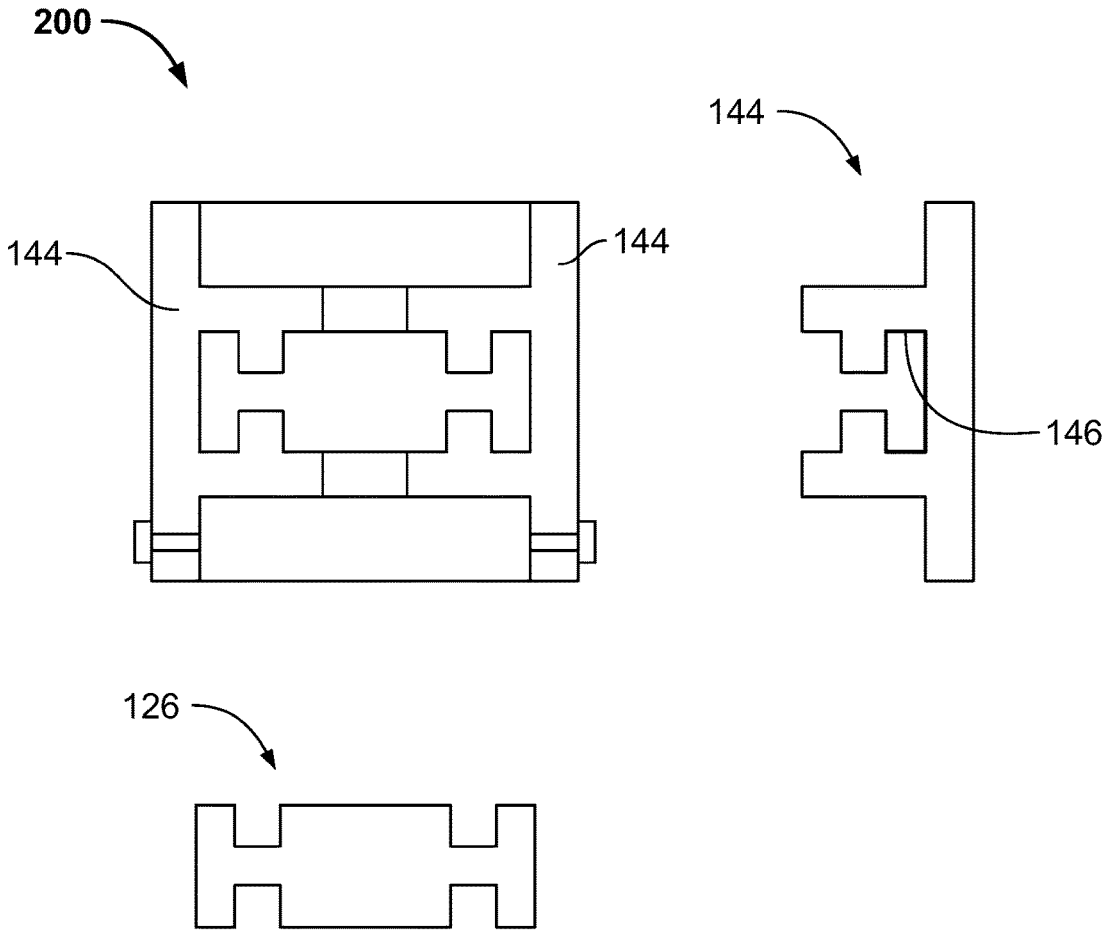
FIG. 3 illustrates an exploded view of a T-slot of the vertical carriage assembly secured to a vertical central beam, according to an embodiment of the present invention.

As illustrated in FIG. 3, the vertical central beam 126 with T-slots 144 attached to the frame 102 of the lifting and transport apparatus 100 is disclosed. The vertical central beam 126 comprises T-slots 144 to match with that of the movable subassembly mounted on the vertical central beam 126 to enable the movement of the vertical carriage assembly 142 by a sliding motion which in turn causes the seating assembly to be moved along with that. The T-slots 144 in the vertical central beam 126 comprises a nylon liner 146 for easy movement of the vertical carriage assembly 142 on the vertical central beam 126.

The design of the horizontal seating plate 134 of the seating assembly is smaller in size to allow the apparatus 100 to be used in confined spaces. Even though the design of the horizontal seating plate 134 of the seating assembly is smaller in size, the lifting capacity of the seating plate is configured to be more than 500 lbs. The seating assembly of the apparatus 100 is completely movable and it can flush to the ground surface with the mobile unit. The wheels 112 are attached to the leg members (104 &106) of the frame 102 via fastening members such as bolts.

In an another embodiment, as shown in FIG. 2A, the lifting and transport apparatus 100 can be mounted onto a wall via the connector bar (122 &124) wherein the connector bar 124 comprises a mounting rail 156 to mount the apparatus 100 onto any surface. Any fasteners can be used to mount the apparatus 100 securely. The fasteners are selected from at least one of a bolt, stud, and a nut. In an exemplary embodiment, 16 inch or 24 inch studs can be used to fix the apparatus 100 onto the wall. The apparatus 100 further comprises a hand-held switch 154 is provided to selectively activate the elevation of the vertical carriage assembly 142. The hand-held switch 154 will be on a six-foot cord for easy access the switch will only activate as it is pushed for safety reasons can be positioned on the actuator 158 to allow a user to switch on the activation mechanism to elevate the seating assembly when the person sits on the seating assembly. In other embodiments, the hand-held switch 154 can also be placed on the vertical carriage assembly 142 or the vertical central block 126.

The lifting and transport apparatus 100 according to the present invention is simple in design and it is lightweight. Therefore, the apparatus 100 is easily portable from place to place and fixed onto the wall or any surface or even attached to the mobile carriage. The design configuration of the apparatus 100 is very small and therefore it is easy to store in most closets. The apparatus 100 can raise a 500 LB person from floor level to 24 inches high safely and under 45 seconds. The apparatus 100 is made out of high strength aluminum which makes the frame 102 of the apparatus 100 extremely strong.

Although the present invention has been described herein in the context of a particular implementation in a particular environment for a particular purpose, those of ordinary skill in the art will recognize that its usefulness is not limited thereto and that the present invention may be beneficially implemented in any number of environments for any number of purposes. Accordingly, the claims set forth below should be construed in view of the full breadth and spirit of the present invention as described herein. Although specific terms may be employed herein, they are used in a generic and descriptive sense only and not for purposes of limit.

What is claimed is:

1. A lifting and transport apparatus for a person comprising:

a frame comprising:

at least two leg members fixedly attached to each other at a first end via a first transverse beam, a second transverse beam is fixedly attached between the leg members at a predetermined distance from the first end, a plurality of wheels removably attached to a bottom section of the leg members via a fastening member, a pair of vertical bars extending from the leg members and separated at a predetermined distance, wherein the vertical bars are fixedly attached to the frame via connector bars and the transverse beams, and a front vertical central beam and a rear vertical central beam each fixedly attached to the frame at a predetermined position via the connector bars and the transverse beams; and a vertical carriage assembly comprising:

a seating assembly comprising:

a horizontal seating plate removably attached to a support member via a hinged coupling, and a vertical resting plate fixedly attached to the support member; and a movable subassembly mounted on the front vertical central beam is fixedly attached to the seating assembly, wherein the front vertical central beam comprises a plurality of T-slots to allow the elevation of the vertical carriage assembly via an actuator mechanism to lift the person.

2. The lifting and transport apparatus of claim 1, wherein the actuator mechanism comprises a linear actuator to elevate the vertical carriage assembly.

3. The lifting and transport apparatus of claim 1, wherein the apparatus comprises a power source built therein configured to provide power to the actuator mechanism for elevating the vertical carriage assembly.

4. The lifting and transport apparatus of claim 1, wherein the apparatus further comprises a portable power unit configured to provide power to the actuator mechanism.

5. The lifting and transport apparatus of claim 1, wherein the actuator mechanism comprises a jack configured to lift the seating assembly via the movable subassembly mounted on the front vertical central beam.

6. The lifting and transport apparatus of claim 1, a hand-held switch mechanism is provided to selectively activate the elevation of the vertical carriage assembly.

7. The lifting and transport apparatus of claim 1, wherein one of the connector bars comprises a mounting rail to mount the lifting apparatus onto a wall.

8. The lifting and transport apparatus of claim 1, wherein one of the connector bars comprises a plurality of stud members to mount the lifting apparatus onto a wall.

9. The lifting and transport apparatus of claim 1, wherein the frame of the lifting apparatus is made from a hardened aluminum.

10. The lifting apparatus of claim 1, wherein the T-slots in the front vertical central beam comprises a nylon liner for movement of the vertical carriage assembly on the front vertical central beam.

11. The lifting and transport apparatus of claim 1, wherein the foot print of the horizontal seating plate is smaller in size when folded in an upright position to allow the apparatus to be used in confined spaces when attached to the wall as a stationary unit.

12. The lifting and transport apparatus of claim 1, wherein the horizontal seating plate is configured to be folded to a predetermined position via the hinged coupling attached to the support member.

13. The lifting and transport apparatus of claim 1, wherein the horizontal seating plate further comprises a supporting rail to securely position the horizontal seating plate on a planar surface.

14. The lifting and transport apparatus of claim 1, wherein the seating assembly comprises a seat belt to prevent the person sitting on the seating assembly from falling down.

* * * * *